US011104017B2

(12) United States Patent
Carlucci et al.

(10) Patent No.: US 11,104,017 B2
(45) Date of Patent: Aug. 31, 2021

(54) HAIR CUTTER BLADE GAP ADJUSTMENT SYSTEM

(71) Applicant: Conair Corporation, Stamford, CT (US)

(72) Inventors: Vito Carlucci, Stratford, CT (US); Dennis J. Colpitts, Fairfield, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 16/427,677

(22) Filed: May 31, 2019

(65) Prior Publication Data

US 2020/0376694 A1 Dec. 3, 2020

(51) Int. Cl.

| | |
|---|---|
| ***B26B 19/06*** | (2006.01) |
| ***B26B 19/20*** | (2006.01) |
| ***B26B 19/38*** | (2006.01) |

(52) U.S. Cl.

CPC ..... *B26B 19/063* (2013.01); *B26B 19/205* (2013.01); *B26B 19/3846* (2013.01)

(58) Field of Classification Search

CPC ..... B26B 19/063; B26B 19/3846; B26B 19/205; B26B 19/20; B26B 19/2826

See application file for complete search history.

(56) References Cited

U.S. PATENT DOCUMENTS 4,009,517 A * 3/1977 Horn ..... B26B 19/20 30/30
4,238,616 A * 12/1980 Nadelson ..... C07D 213/69 548/248
4,328,616 A * 5/1982 Andis ..... B26B 19/3846 30/216

(Continued)

FOREIGN PATENT DOCUMENTS

| | | |
|---|---|---|
| WO | 2017120610 A2 | 7/2017 |
| WO | 2018/210670 A2 | 11/2018 |
| WO | PCT/US20/29101 | 7/2020 |

OTHER PUBLICATIONS

Youtube.com, "Babyliss Pro Silver," https://www.youtube.com/watch?v=f-sKSGRcJWw, reviewed as early as Jan. 2020, 1 page.

*Primary Examiner* — Ghassem Alie
*Assistant Examiner* — Fernando A Ayala
(74) *Attorney, Agent, or Firm* — Lawrence Cruz, Esq.; Ryan, Mason & Lewis, LLP

(57) ABSTRACT

A hair cutting system includes a handle defining a longitudinal axis, a strut mounted to the handle and a hair cutting blade assembly coupled to the strut. The cutting blade assembly includes a stationary blade defining cutting teeth having blade edges and a movable blade defining cutting teeth having blade edges and capable of reciprocal movement relative to the stationary blade in a horizontal direction. The movable blade and the stationary blade are movable relative to each other in a longitudinal direction to adjust a longitudinal position of the movable blade relative to the stationary blade to selectively vary a distance between the blade edges of the stationary blade and the blade edges of the movable blade. A releasable lock is configured to selectively lock and release the stationary blade and the movable blade with respect to each other in the longitudinal direction.

20 Claims, 12 Drawing Sheets

(56) References Cited

U.S. PATENT DOCUMENTS

| | | | | |
|---|---|---|---|---|
| 4,458,417 | A * | 7/1984 | Andis | B26B 19/06 30/216 |
| 5,386,634 | A | 2/1995 | Ogle et al. | |
| 6,243,955 | B1 * | 6/2001 | Forbers | B26B 19/20 30/195 |
| D456,947 | S | 5/2002 | Hoffman et al. | |
| D462,482 | S | 9/2002 | Rizzuto, Jr. et al. | |
| D464,466 | S | 10/2002 | Rizzuto, Jr. et al. | |
| D470,272 | S | 2/2003 | Fong | |
| 6,536,116 | B2 | 3/2003 | Fung | |
| 6,862,810 | B2 * | 3/2005 | Braun | B26B 19/06 30/210 |
| 7,290,349 | B1 | 11/2007 | Carpenter | |
| 7,350,314 | B2 | 4/2008 | McCambridge et al. | |
| D696,459 | S | 12/2013 | Chan | |
| 8,806,757 | B2 * | 8/2014 | Moseman | B26B 19/3846 30/43.92 |
| 9,144,913 | B2 | 9/2015 | Gross et al. | |
| D747,551 | S | 1/2016 | Marut | |
| D785,249 | S | 4/2017 | Torres | |
| D800,387 | S | 10/2017 | Ino | |
| 9,943,972 | B2 | 4/2018 | Werner | |
| D836,841 | S | 12/2018 | de Bélizal | |
| D903,196 | S | 11/2020 | Carlucci | |
| 2002/0000043 | A1 | 1/2002 | Beutel et al. | |
| 2007/0144025 | A1 * | 6/2007 | McCambridge | B26B 19/3846 33/633 |
| 2012/0198716 | A1 * | 8/2012 | Tonges | B26B 19/3893 33/641 |
| 2014/0053412 | A1 | 2/2014 | Carlucci et al. | |
| 2014/0115865 | A1 * | 5/2014 | Gross | B26B 19/3846 29/465 |
| 2014/0331504 | A1 | 11/2014 | Michel | |
| 2016/0075039 | A1 | 3/2016 | Werner | |
| 2016/0207209 | A1 | 7/2016 | Ulery, II et al. | |
| 2018/0133910 | A1 | 5/2018 | Holmes | |
| 2019/0152076 | A1 | 5/2019 | Sablatschan | |
| 2019/0232509 | A1 * | 8/2019 | Werner | B26B 19/06 |
| 2020/0055205 | A1 | 2/2020 | Werner et al. | |
| 2020/0156271 | A1 * | 5/2020 | Kruse | B26B 19/205 |

* cited by examiner

HAIR CUTTER BLADE GAP ADJUSTMENT SYSTEM

BACKGROUND

1. Technical Field

The present disclosure relates to hair cutters, and, in particular, relates to a hair cutting system with an integral blade adjustment mechanism for adjusting the relative gap between blades to thereby vary the cutting length of hair.

2. Discussion of Related Art

Electric hair shavers, clippers or trimmers may incorporate a clipper blade assembly having a stationary blade and a reciprocating blade. The stationary blade and the reciprocating blade each have a plurality of teeth along leading edges of the blades. The reciprocating blade oscillates with respect to the stationary blade to trim hair disposed between the teeth. Examples of hair clippers are disclosed in commonly assigned U.S. Pat. No. 6,536,116 to Fung, U.S. Pat. No. 6,742,262 to Rizzuto et al., and U.S. Patent Publication No. 2014/0115901A1 to Liao, the entire contents of each disclosure being hereby incorporated by reference herein.

Several deficiencies are inherent in conventional clipper designs. For example, adjusting the length of cut between the cutting blades, sometimes referred to as "gap" in the barber industry, often requires removal of the blade assembly from the handle, and securing the relative positions of the blades followed by reattachment of the blades to the handle. This operation is difficult in and of itself. Compounding the issue is that the adjustment of the blades often results in angulation of one blade relative to another. This is undesirable in that the resulting cut with the angulated blades is inconsistent, thereby resulting in additional operator difficulties.

SUMMARY

Accordingly, the present disclosure is directed to further improvements in hair clippers, shavers, trimmers, etc. For example, illustrative embodiments of the present disclosure permit adjustment of the blade cut while the blades are mounted to the handle. In exemplary embodiments, the present invention further ensures direct relative linear movement of the cutting blades such that the cutting blades are "aligned" with respect to each other. In certain embodiments, the cutting edges of the cutting blades are in parallel relation to each other when in the aligned position. These features amongst other features provides a clean, consistent and easily controllable cut.

In accordance with one exemplary embodiment, a hair cutting system includes a handle defining a longitudinal axis, a strut mounted to the handle and a hair cutting blade assembly coupled to the strut. The cutting blade assembly includes a stationary blade defining cutting teeth having blade edges and a movable blade defining cutting teeth having blade edges and capable of reciprocal movement relative to the stationary blade in a horizontal direction. The movable blade and the stationary blade are movable relative to each other in a longitudinal direction to adjust a longitudinal position of the movable blade relative to the stationary blade to selectively vary a distance between the blade edges of the stationary blade and the blade edges of the movable blade. A releasable lock is configured to selectively lock and release the stationary blade and the movable blade with respect to each other in the longitudinal direction.

The hair cutting system further includes an adjustment tool mounted relative to the cutting blade assembly and operatively engageable with the movable blade. The adjustment tool and the strut are correspondingly configured such that longitudinal movement of the adjustment tool imparts corresponding longitudinal movement of the movable blade to facilitate adjustment of the longitudinal position of the movable blade relative to the stationary blade. The adjustment tool may include inner walls defining an internal recess for at least partially receiving the strut wherein the inner walls cooperating with the strut during longitudinal movement of the movable blade to facilitate linear movement of the movable blade relative to the stationary blade.

The releasable lock includes at least one alignment fastener coupled to the movable blade, and configured to releasably secure the movable blade at a plurality of select longitudinal positions. The alignment fastener may include an alignment screw.

A slider may be mounted within a recess of the stationary blade. The slider includes a threaded anchor for at least partial threaded reception of the alignment screw. The slider is configured to reciprocate within the recess of the stationary blade during reciprocal movement of the movable blade.

The adjustment tool includes a driver releasably mounted thereto, which is manipulatable to control movement of the alignment screw. One or more alignment screws may be provided. The one or more alignment screws are accessible to the driver with the cutting assembly mounted to the strut.

A bracket may be disposed between the movable blade and the strut. The bracket includes at least one elongated opening to receive the screw. The screw traverses the elongated opening during longitudinal movement of the movable blade.

Other features of the present disclosure will be appreciated from the following description of same.

BRIEF DESCRIPTION OF THE DRAWINGS

Various embodiments of the present disclosure are described hereinbelow with references to the drawings, wherein.

DETAILED DESCRIPTION

Figure 1:
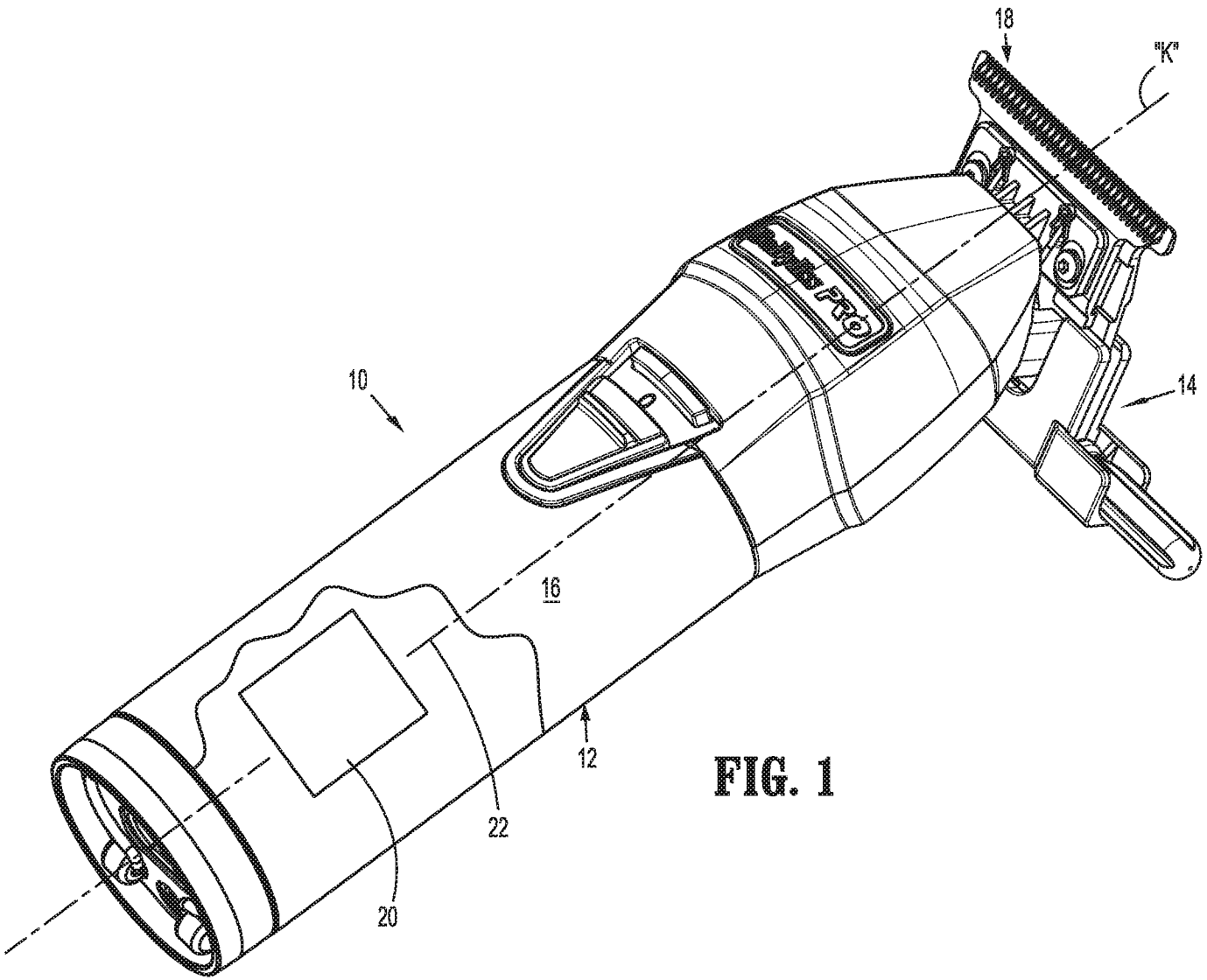
FIGS. 1 and 2 are front and rear perspective views of the hair cutting system in accordance with the principles of the present disclosure illustrating the hair cutter and the adjustment tool mounted to the hair cutter.
Figure 2:
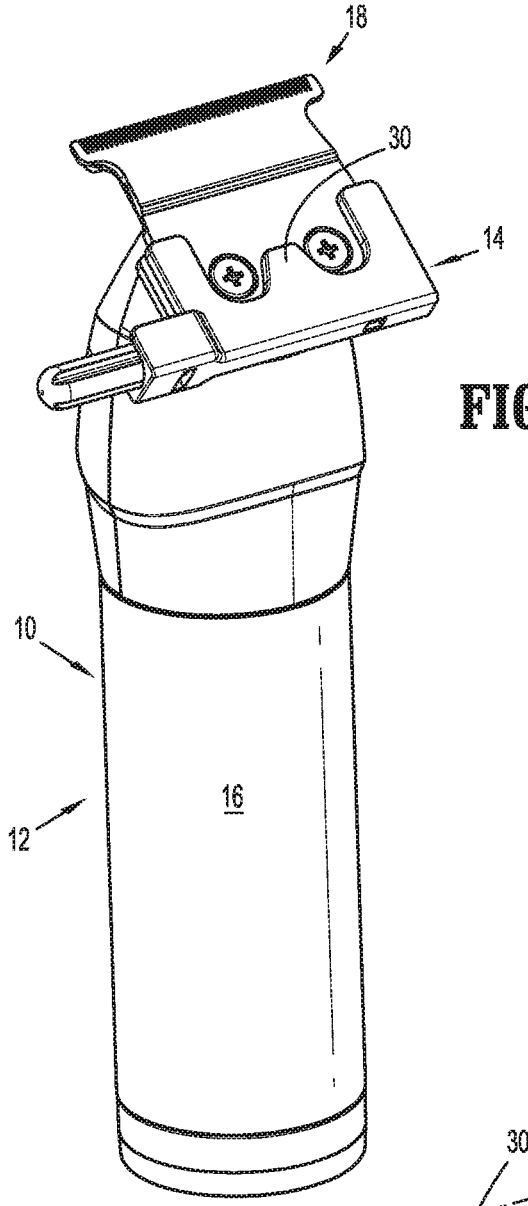
Figure 3:
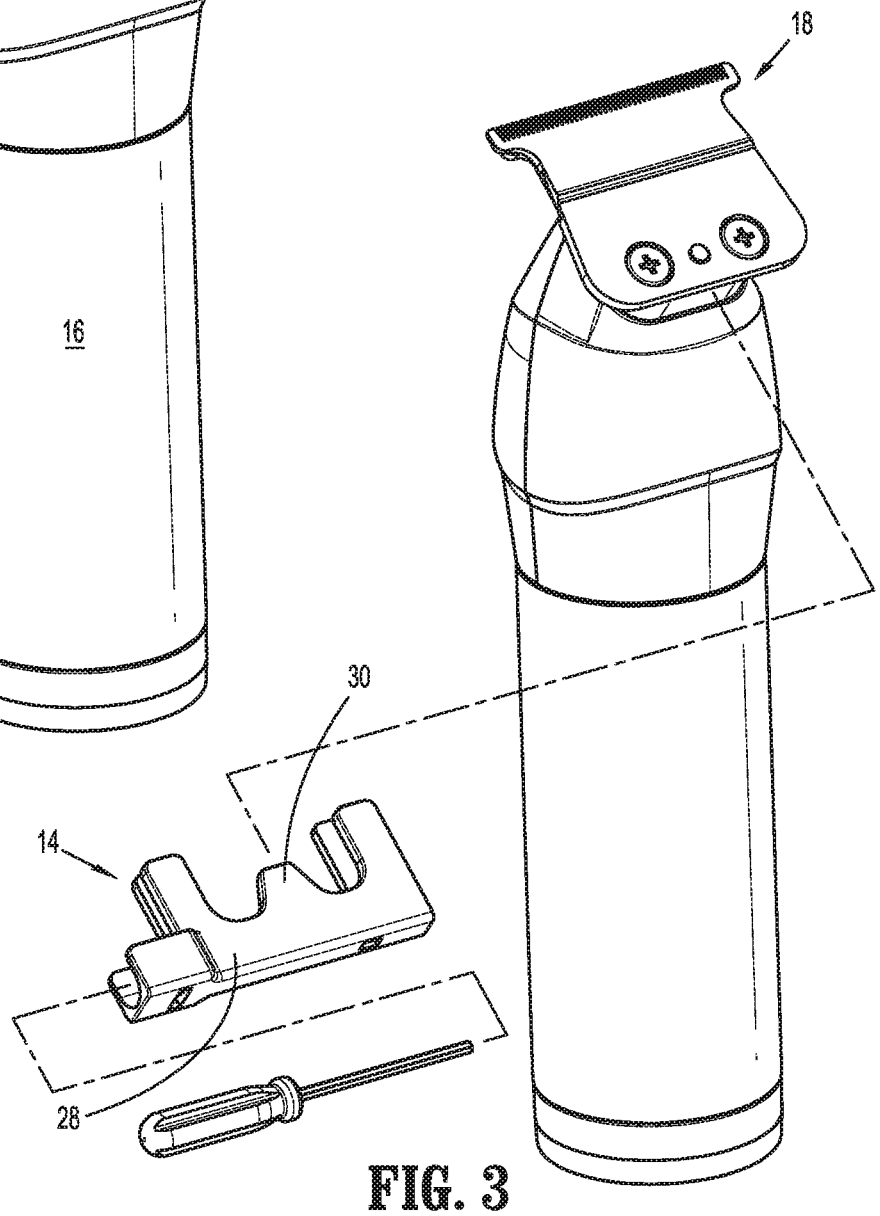
FIG. 3 is a perspective view illustrating the adjustment tool released from the hair cutter with the driver released from the adjustment tool according to one or more embodiments of the present invention.

Referring now to the drawing figures wherein like reference numerals identify similar or like components throughout the several views, FIGS. 1-3 illustrate the hair cutting system in accordance with the principles of the present disclosure. The hair cutting system 10 includes a hair cutter 12 and an adjustment tool 14 which is releasably mountable to the hair cutter 12. The hair cutter 12 may be a hair clipper, a shaver, a hair trimmer or any other personal grooming device capable of cutting, trimming, shaving etc., hair from any part of the human body. For simplicity, the device will be referred to hereinafter as a "hair cutter". The hair cutter 12 includes a handle 16 defining a longitudinal axis "k" and a cutting blade assembly 18 mounted adjacent the remote end of the handle 16. The handle 16 includes a drive mechanism, schematically illustrated in FIG. 1, as reference numeral 20. The drive mechanism 20 may be powered by an external electrical power source connected by an electrical cord (not shown) or it may include a battery-operated motor and one or more drive shafts 22 for imparting movement, including but not limited to oscillating, reciprocating or any other type of motion to the cutting blade assembly 18. When adjustment of the blade gap is desired, the adjustment tool 14 is utilized to be operated as described in greater detail hereinbelow. In general, the adjustment tool 14 is used to facilitate positioning and proper alignment of the cutting blades of the cutting blade assembly 18 while adjusting the gap in order to vary the length of cut of the cutting blade assembly 18 for cutting beards, hair, body hair etc.

Referring now to FIGS. 4-7, the adjustment tool 14 will be discussed. The adjustment tool 14 has a pair of spaced walls 24, e.g., proximal wall 24*a* and distal wall 24*b*, arranged in the general shape of a "U" which are connected by a base 26. The spaced walls 24*a*, 24*b* define a spacing 28 therebetween which at least partially receives the cutting blade assembly 18 to mount the adjustment tool 14 to the cutting blade assembly 18. A rear wall 30 extends upwardly from the distal wall 24*b* and engages the rear of the cutting blade assembly 18 as shown in FIG. 2. In one exemplary embodiment, the spacing 28 between the spaced walls 24 is dimensioned such that the spaced walls 24 and the rear wall 30 engage the front and rear of the cutting blade assembly 18 in friction relation therewith. It is also envisioned that the spacing 28 defines a dimension which is less than the width of the cutting blade assembly 18 whereby the spaced walls 24 and/or the rear wall 30 flex slightly outward to further facilitate securement of the adjustment tool 14 to the cutting blade assembly 18. Other mechanisms are also envisioned. The adjustment tool 14 further includes a driver receptacle 32 and opposed detents 34 within the driver receptacle 32. A pair of lock ledges 36 are mounted adjacent the rear wall 30 and depend inwardly into the spacing 28.

The proximal wall 24*a* of the adjustment tool 14 defines an internal recess 25 which defines a dimension "d1" the significance of which will be described hereinbelow. The proximal wall 24*a* further defines upper surfaces 27 which assist in adjusting the blades of the cutting blade assembly 18. Moreover, the internal recess 25 and the upper surfaces 27 of the proximal wall 24*a* cooperate to ensure direct linear adjustment of the cutting blade assembly 18 without any rotation, angulation etc. of the blades of the cutting blade assembly 18 relative to each other.

Figure 4:
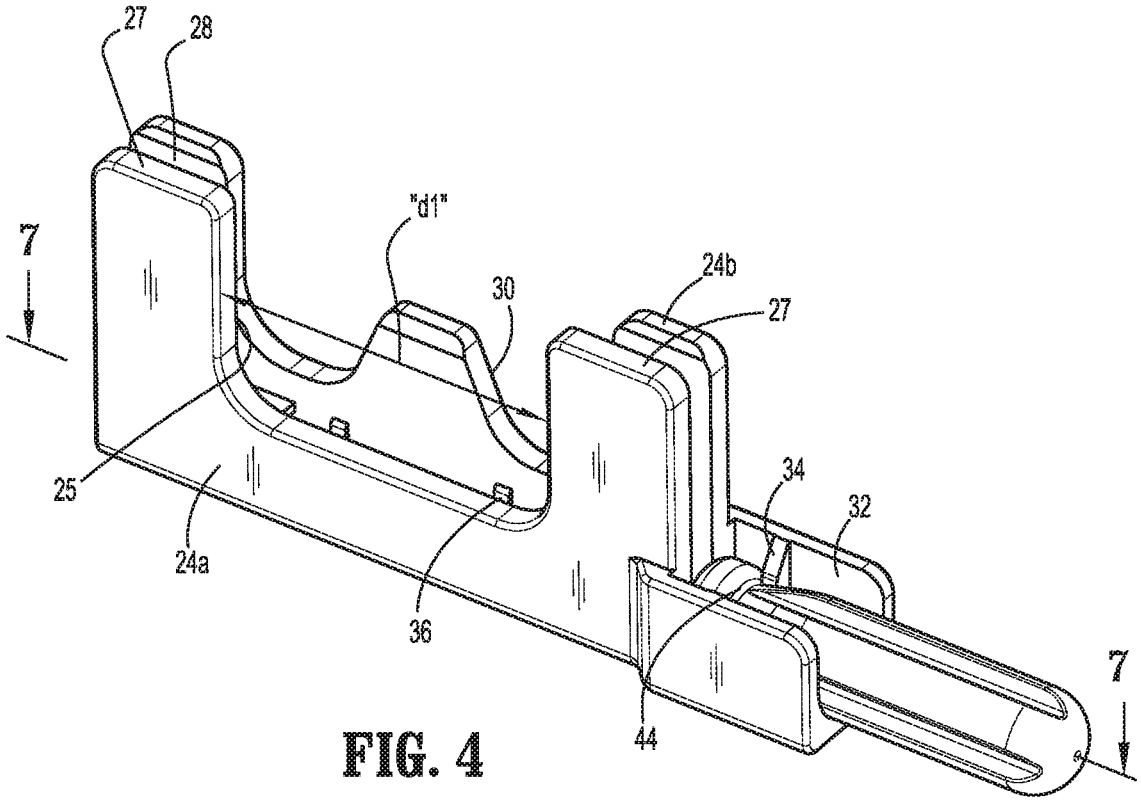
FIG. 4 is a perspective view illustrating the adjustment tool with the mounted driver according to one or more embodiments of the present invention.
Figure 5:
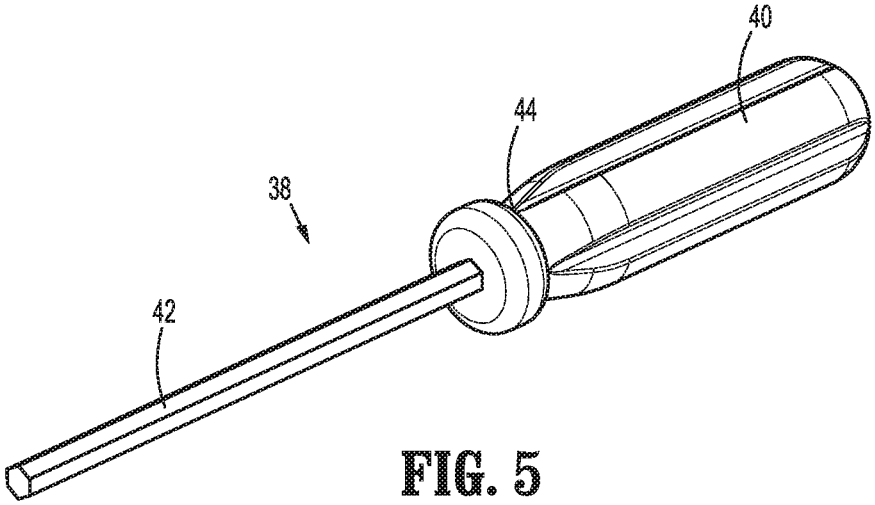
FIG. 5 is a perspective view of the driver according to one or more embodiments of the present invention.
Figure 6:
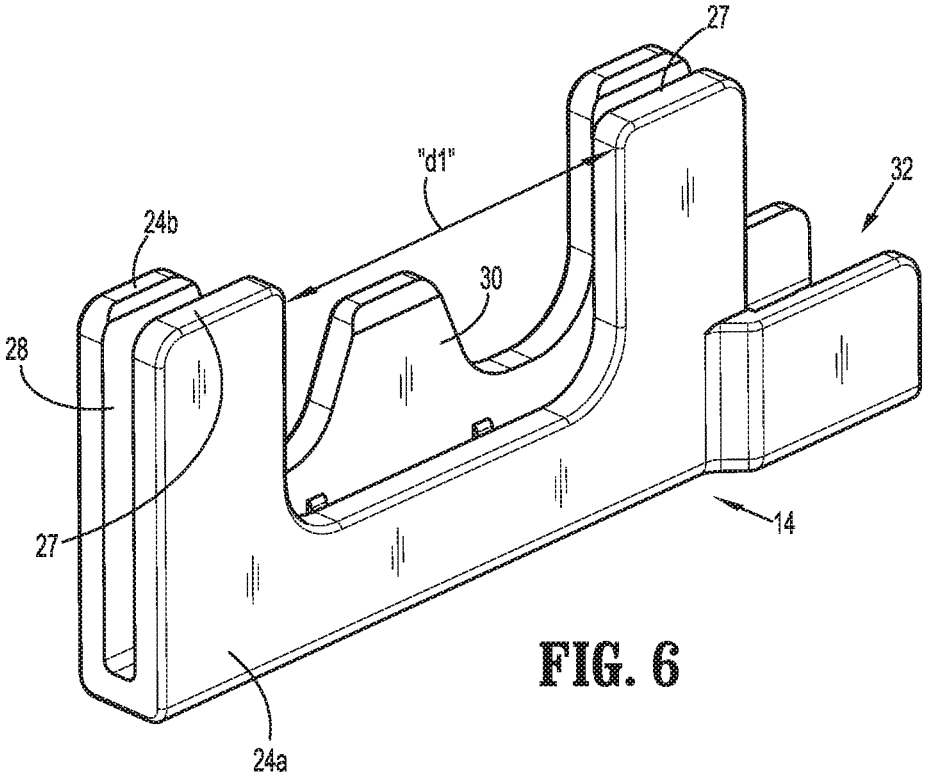
FIG. 6 is a perspective view of the adjustment tool according to one or more embodiments of the present invention.
Figure 7:
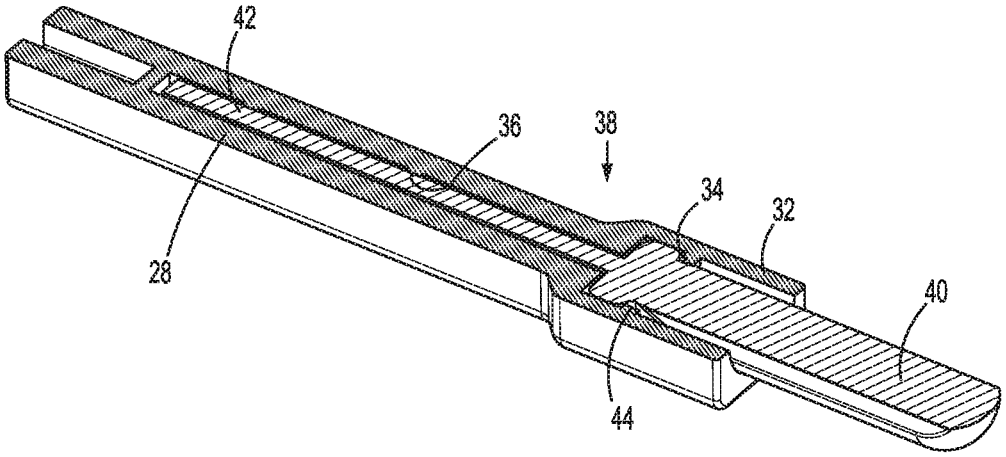
FIG. 7 is a perspective view in cross-section taken along the lines 7-7 of FIG. 4 illustrating the driver mounted within the accessory tool according to one or more embodiments of the present invention.

With reference to FIGS. 4, 5 and 7, the adjustment tool 14 includes a driver 38 having a drive handle 40 and a drive member 42 extending from the drive handle 40. The drive handle 40 includes a peripheral recess 44 which cooperates with the opposed detents 34 within the driver receptacle 32 of the adjustment tool 14 to secure the drive handle 40 to the adjustment tool 14. The drive member 42 may have a hexagonal head or other shaped head, e.g., a Phillips head, a straight head as well as any other polygon configuration. The driver 38 is utilized to loosen and tighten fastener elements, e.g., screws of the cutting blade assembly 18 to permit selective adjustment of the cutting blades to vary a length of cut as will be discussed hereinbelow. The drive member 42 may further be secured within the spacing 28 of the adjustment tool 14 by the lock ledges 36. The lock ledges 36 may bias outwardly upon insertion of the drive member 42 and then return to their normal positions securing the drive member 42, for example, engaging the outer periphery of the drive member 42.

Figure 8:
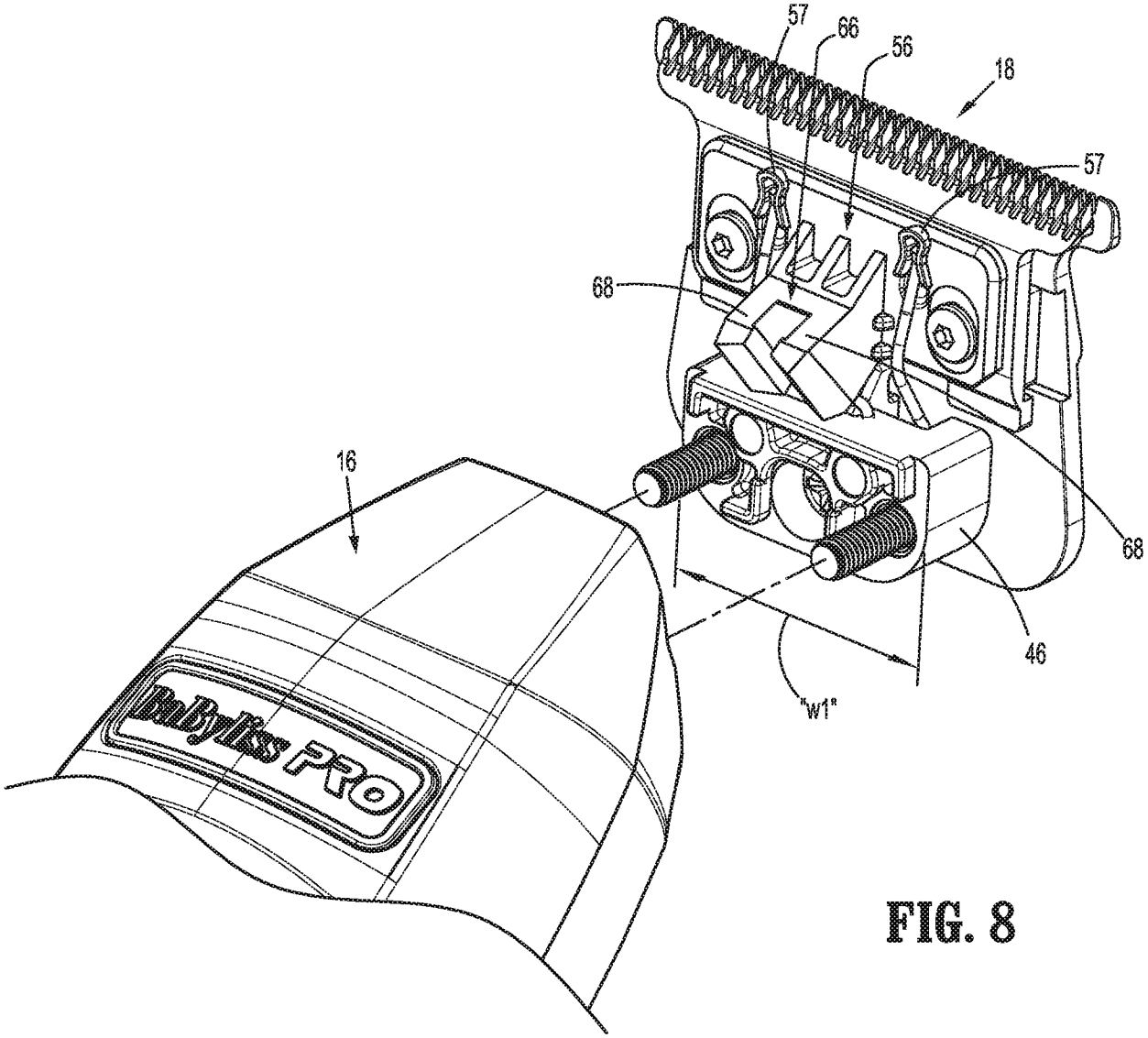
FIG. 8 is a perspective view illustrating the cutting blade assembly prior to assembly to the handle.

Referring now to FIGS. 8-12, further details of the hair cutter 12 and the cutting blade assembly 18 will be discussed. FIG. 8 illustrates the cutting blade assembly 18 prior to being assembled to the handle 16. With reference to FIG. 8 and the exploded view of FIG. 9, the hair cutter 12 includes a strut 46 which is directly mounted to the handle 16 and to the cutting blade assembly 18. The strut 46 is dimensioned to displace the cutting blade assembly 18 away from the handle 16 to permit access to various features of the cutting blade assembly 18 without having to remove the cutting blade assembly 18 from the handle 16. The strut 46 defines a central opening 48 for receiving a screw 50 and two side openings 52 extending completely through the strut 46. As best depicted in FIG. 8, the strut 46 defines an outer dimension "w1" which generally approximates the internal dimension "d1" of the proximal wall 24*a* of the adjustment tool 14.

The cutting blade assembly 18 includes, from proximal to distal, an oscillation spring 54, a bracket 56, a movable blade 58, a slider 60 and a stationary blade 62. The oscillation spring 54 at least partially resides in a pair of distal recesses 64 in the strut 46 and engages the bracket 56, e.g., spring holders 57 of the bracket 56 (FIG. 8). The oscillation spring 54 normally biases the bracket 56 and thus the movable blade 58 to a central-most position in general alignment with the longitudinal axis "k." The bracket 56 includes a central segment 66 (FIG. 8) having two opposed vertical walls 68 which receive the eccentric rotating shaft (not shown in FIGS. 8-12) extending from the handle 16. Rotation of the eccentric shaft causes the bracket 56 and the movable blade 58 secured to the bracket 56 to correspondingly oscillate in a known manner.

Figure 9:
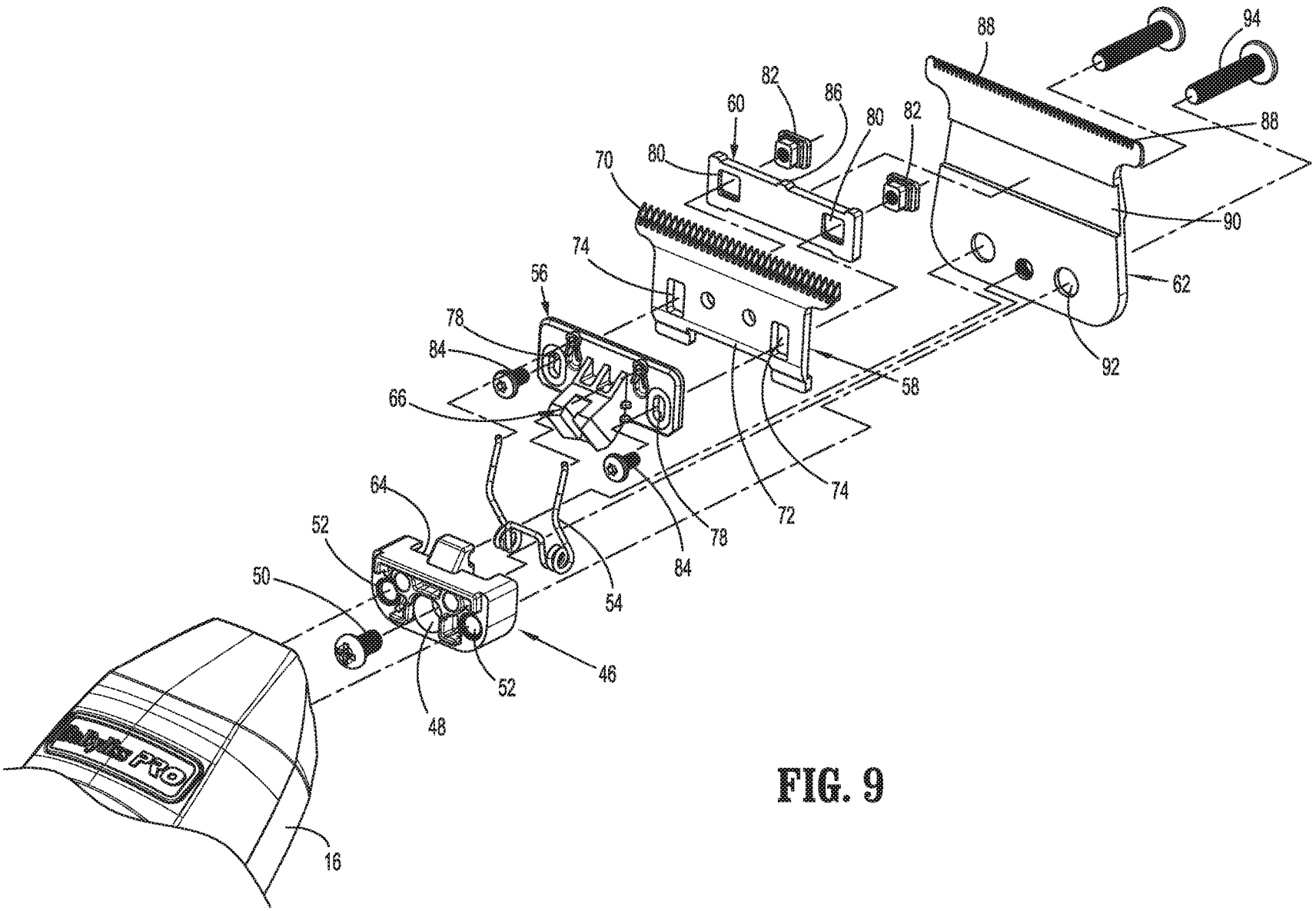
FIG. 9 is an exploded perspective view of the cutting blade assembly and the strut according to one or more embodiments of the present invention.
Figure 10:
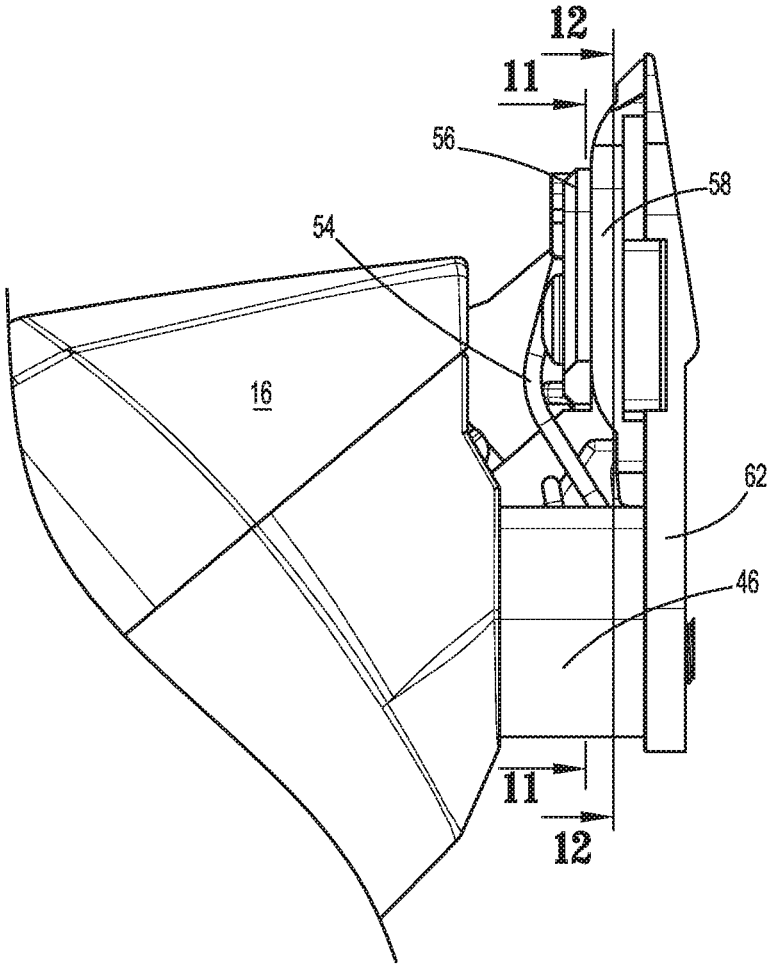
FIG. 10 is a side elevation view of a remote end of the handle, the strut and the cutting blade assembly according to one or more embodiments of the present invention.
Figure 11:
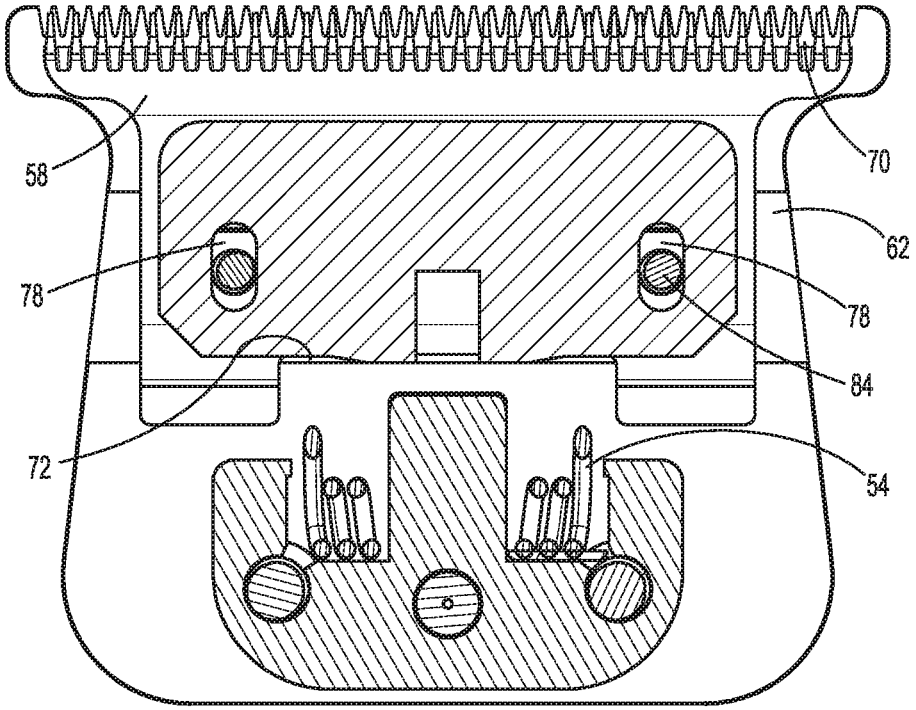
FIG. 11 is a cross-sectional view taken along the lines 11-11 of FIG. 10 according to one or more embodiments of the present invention.

As best depicted in FIGS. 9 and 11, the movable blade 58 incudes cutting teeth 70 defining an outer cutting edge. The movable blade 58 further includes a proximal ledge 72 upon which the bracket 56 may reside and two elongated outer rectangular-shaped openings 74 (see also FIG. 12). The rectangular-shaped openings 74 receive alignment screws 84 which extend through the elongated openings 78 of the bracket 56. The rectangular-shaped openings 74 and the elongated openings 78 are generally elongated in the vertical direction.

Figure 12:
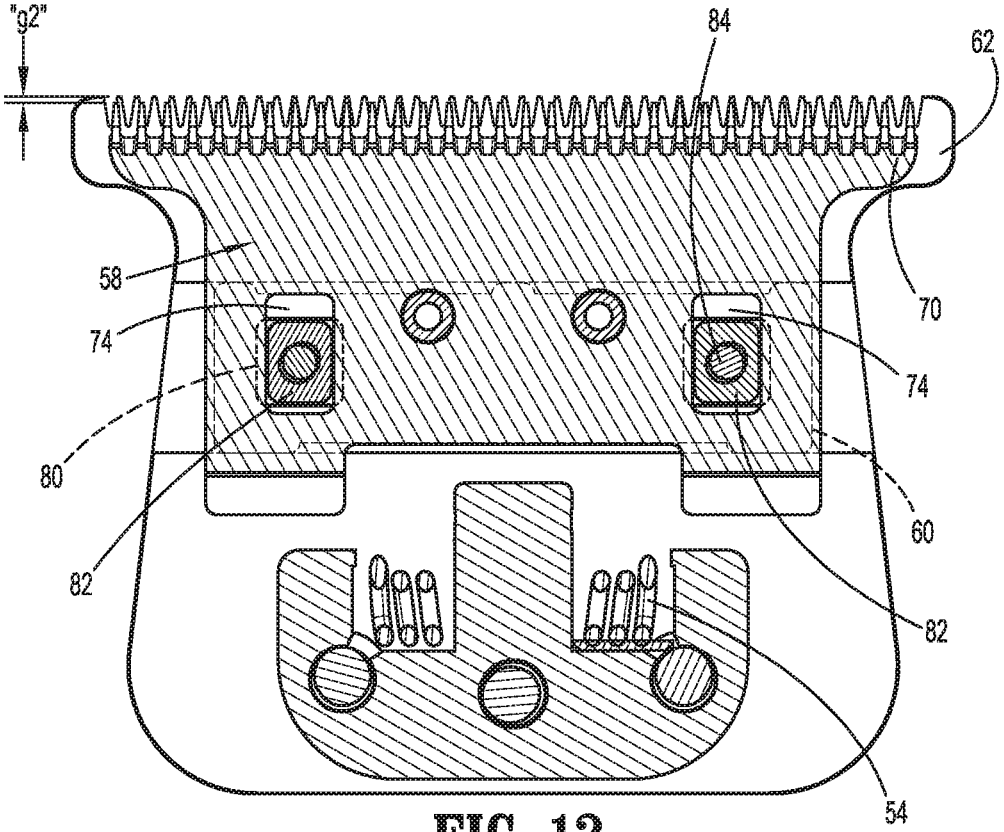
FIG. 12 is a cross-sectional view taken along the lines 12-12 of FIG. 10 illustrating the cutting edges of the cutting blades in an approximated condition according to one or more embodiments of the present invention.

As best illustrated in FIGS. 9 and 12, the slider 60 is generally rectangular in shape and has two rectangular openings 80 in alignment with the rectangular-shaped openings 74 of the movable blade 58. Secured within the openings 80 of the slider 60 are internally threaded anchors 82. The anchors 82 receive the alignment screws 84 which extend through the slotted openings 78 of the bracket 56 and the rectangular-shaped openings 74 of the movable blade 58 for threaded engagement with the threaded anchors 82 of the slider 60 to secure the slider 60, the movable blade 58 and the bracket 56 relative to each other. The slider 60 further includes one or more, e.g., three protrusions 86 on each of its upper and lower surfaces.

As best depicted in FIG. 9, the stationary blade 62 includes cutting teeth 88 defining an outer cutting edge. The stationary blade 62 also includes a recess 90 which receives the slider 60. The slider 60 reciprocates within the recess 90 upon reciprocating movement of the movable blade 58 and the bracket 56. The protrusions 86 on the upper and lower surfaces of the slider 60 minimize the areas of contact relative to the surfaces of the stationary blade 62 defining the recess 90 to reduce surface area contact and facilitate sliding movement of the slider 60 within the recess 90. The stationary blade 62 further includes two large openings 92. The openings 92 receive fasteners or screws 94 utilized to secure the stationary blade 62 to the handle 16.

Figure 13:
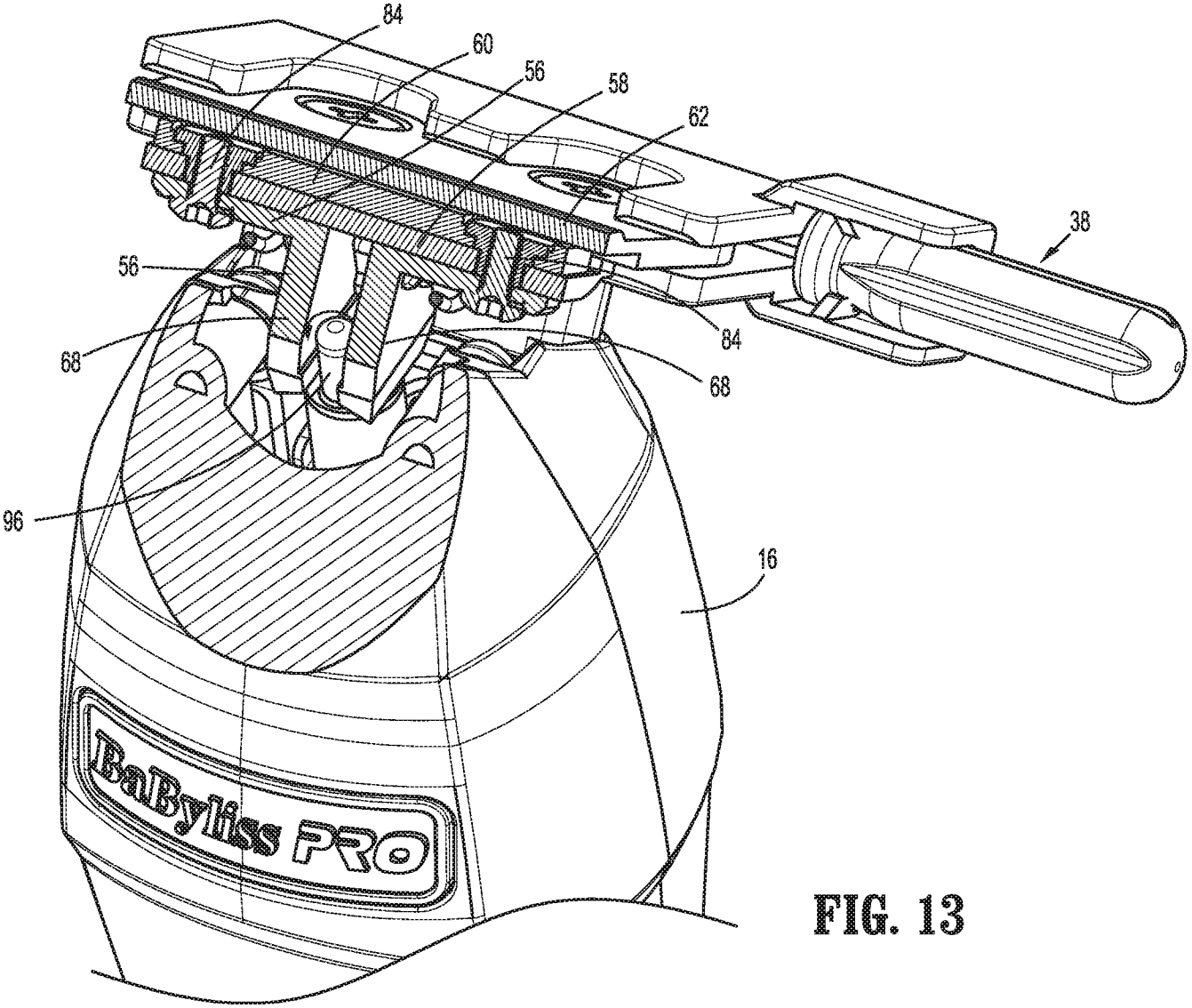
FIG. 13 is a perspective view in partial cross-section illustrating the components of the cutting blade assembly and the adjustment tool according to one or more embodiments of the present invention.

Referring now to the perspective view in partial cross-section of FIG. 13, the eccentric rotating shaft 96 coupled to the one or more drive shafts 22 of the drive mechanism 20 (FIG. 1) is shown disposed within the two opposed vertical walls 68 of the bracket 56. Rotation of the eccentric shaft 96 causes the bracket 56 to reciprocate and/or oscillate with the connected movable blade 58. Also depicted in FIG. 13 are the alignment screws 84 which couple the bracket 56, the movable blade 58 and the slider 60.

Figure 14:
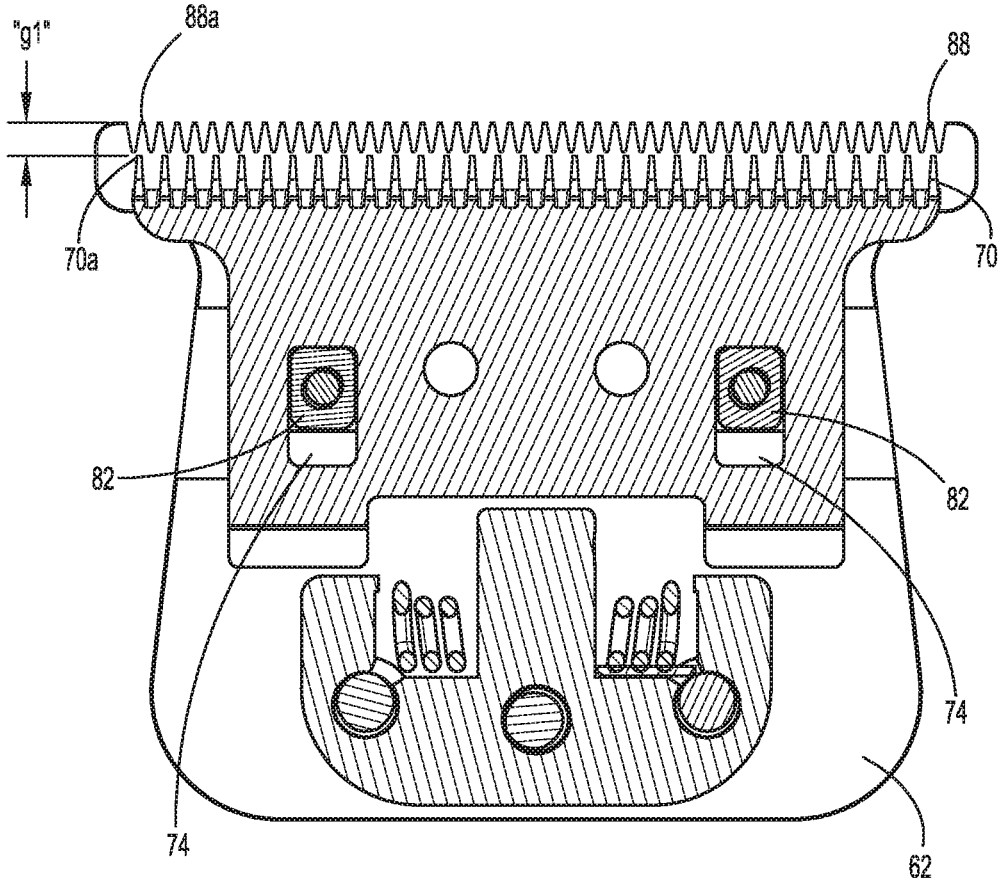
FIG. 14 is a cross-sectional view similar to the view of FIG. 12 illustrating the cutting edges of the cutting blades in a fully displaced condition.
Figure 15:
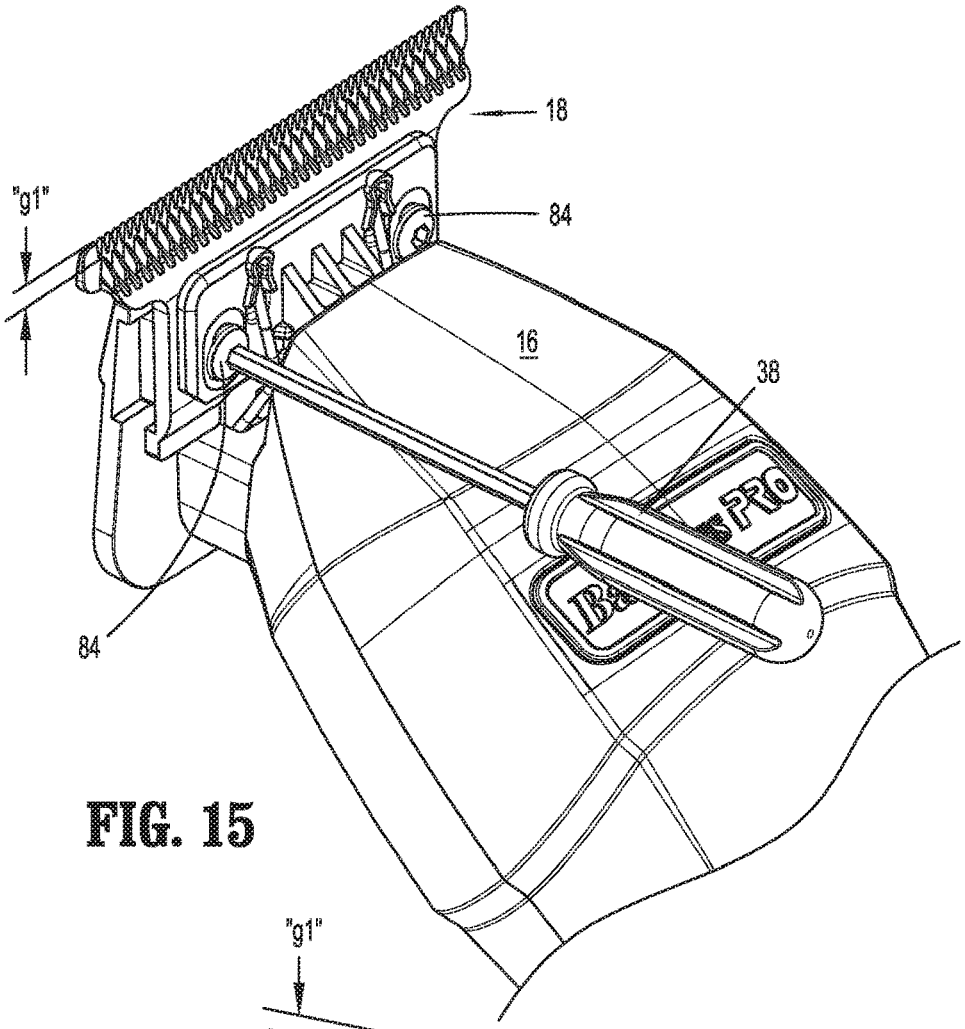
FIGS. 15-18 are views illustrated an exemplary method of use of the adjustment tool in adjusting the spacings of the blades of the cutting blade assembly.
Figure 16:
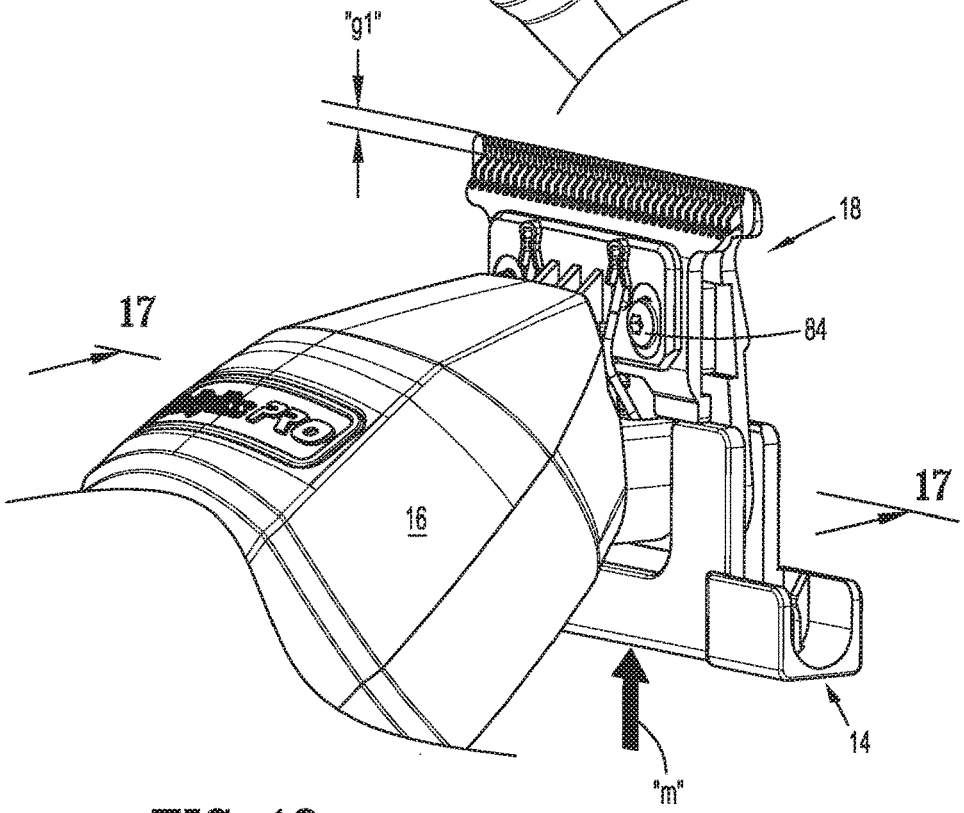
Figure 17:
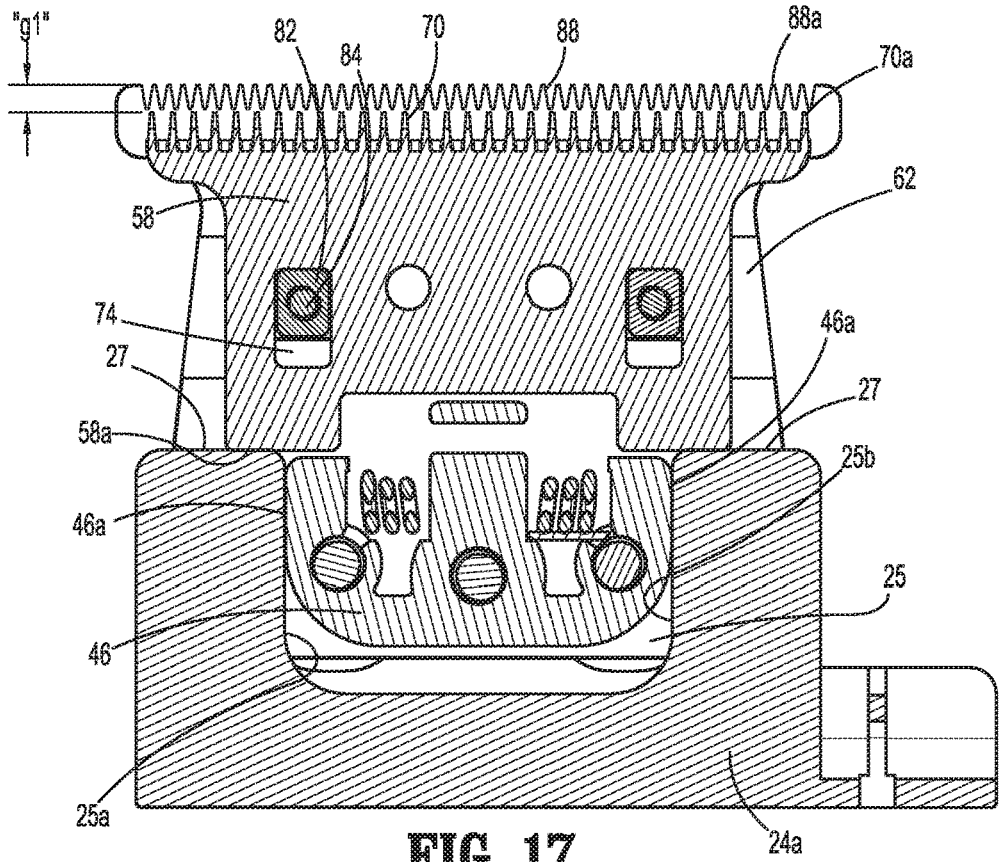
Figure 18:
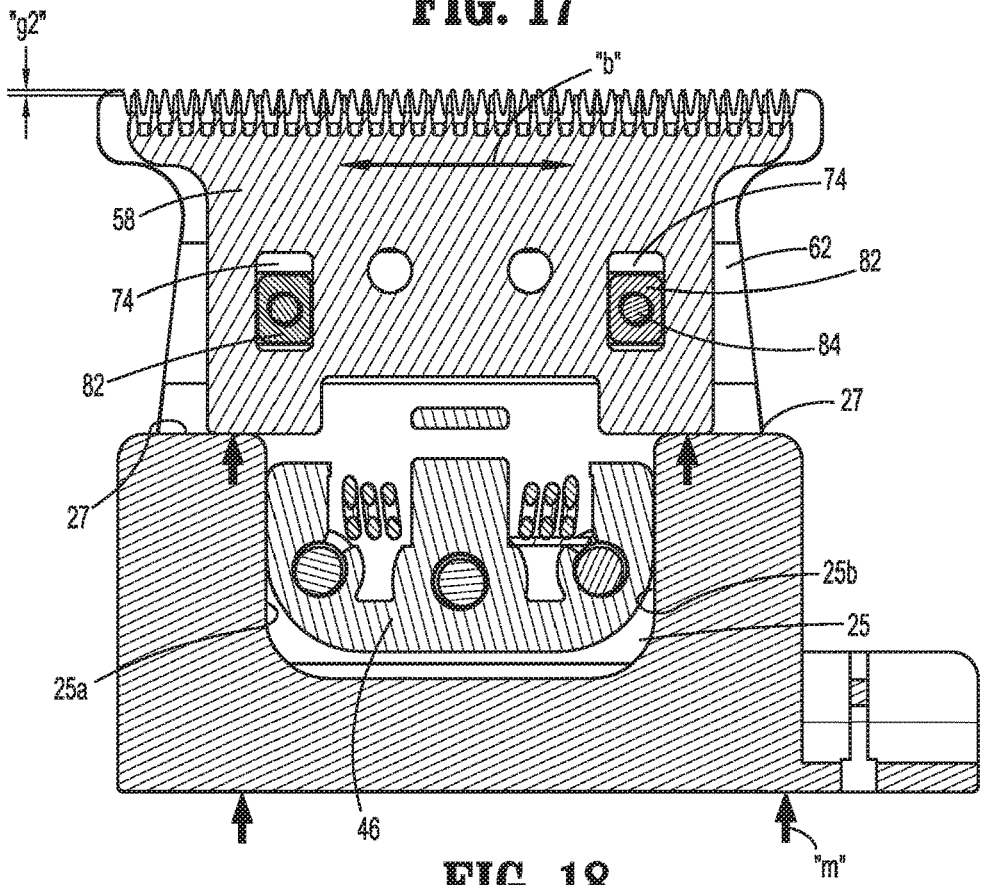

With reference to FIGS. 14-18, the operation of the hair cutting system 10 including the hair cutter 12 and the adjustment tool 14 will now be discussed. FIG. 14 is a view similar to the view of FIG. 12, and depicts a fully displaced condition of the movable blade 58 and the stationary blade 62. In the fully displaced condition, the outer blade edges 70*a* of the cutting teeth 70 are in their maximum displaced condition represented by gap "g1" relative to the outer blade edges 88*a* of the cutting teeth 88 of the stationary blade 62. Compare with FIG. 12 where the outer blade edges 70*a*, 88*a* are in the closed or approximated condition represented by gap "g2". To adjust the gap, or relative positioning of the movable blade 58 and the stationary blade 62, the driver 38 is removed from the adjustment tool 14 as depicted in FIG. 15. In embodiments, the driver 38 may be removed from the adjustment tool 14 without removal of the adjustment tool 14 relative to the cutting blade assembly 18. In other embodiments, the adjustment tool 14 may be removed to permit removal of the driver 38. The driver 38 is utilized to loosen both alignment screws 84. It is noted that the presence of the strut 46 displaces the alignment screws 84 a sufficient distance from the handle 16 such that the operator can readily access the alignment screws 84 with the driver 38 without the need to first remove the blade assembly 18 from the handle 16. Thereafter, the adjustment tool 14, if previously removed, is positioned onto the cutting blade assembly 18 with the cutting blade assembly 18 being at least partially received within the spacing 28 of the adjustment tool 14 (FIG. 16). As best depicted in FIGS. 16-18, the recess 25 defined within the proximal wall 24*a* of the adjustment tool 14 receives the strut 46 in a close tolerance fit. More specifically, the internal dimension "d1" (FIGS. 4 and 6) of the recess 25 in the proximal wall 24*a* of the adjustment tool 14 approximates the width "w1" of the strut 46 (FIG. 8) whereby the corresponding interior wall surfaces 25*a*, 25*b* defining the recess 25 of the adjustment tool 14 and the outer walls 46*a* of the strut 46 are in contacting relation. As also shown, the upper surfaces 27 of the proximal wall 24*a* of the adjustment tool 14 engage the lower surface 58*a* of the movable blade 58, i.e., on both sides of the movable blade 58. To selectively close the gap between the blade edges 70*a*, 88*a* of the cutting teeth 70, 88, the adjustment tool 14 is advanced upwardly in the longitudinal direction of the directional arrows "m" of FIGS. 16 and 18 such that the upper surfaces 27 of the adjustment tool 14 and the lower surface 58*a* of the movable blade 58 cause the movable blade 58 to move upwardly closing the gap between the outer blade edges 70*a*, 88*a* of the movable blade 58 and the stationary blade 62. Due to the cooperative configurations of the strut 46 and the internal recess 25 of the adjustment tool 14, the movable blade 58 is prevented from tilting, angulating, rotating etc. and moves directly linearly with respect to the stationary blade 62. Thus, the blade edges 70*a*, 88*a* of the respective movable and stationary blades 58, 62 remain in their parallel relation during and after adjustment of the movable blade 58. This ensures that the cut or trim of the hair is linear and consistent. During longitudinal movement of the movable blade 58, the alignment screws 84 traverse the elongated openings 78 of the bracket 56 (FIG. 11) and the anchors 82 traverse the elongated outer rectangular-shaped openings 74 of the movable blade 58 (FIGS. 17 and 18). The alignment screws 84 may be tightened at any time to secure the relative positions of the movable blade 58 and the stationary blade 62. It is to be appreciated that the movable blade 58 may be adjusted to a plurality of select positions relative to the stationary blade 62 between the fully displaced condition and the approximated condition and the adjustment screws 84 to selectively adjust the length of cut as desired.

With the movable blade 58 and the stationary blade 62 in their desired positions, the hair cutter 12 may be activated to cause reciprocating movement of the movable blade 58 (in the horizontal direction of directional arrow "b" (FIG. 18) to cut, trim or shave hair.

Thus, the hair cutter system with the adjustment tool 14 in cooperation with the strut 46 ensure that the movable blade 58 is arranged in its intended aligned position after each adjustment. Although in exemplary embodiments, the aligned position is described as inclusive of the cutting edges of the movable blade 58 and the stationary blade 62 being in parallel relation, as a direct linear movement of the movable blade 58 relative to the stationary blade 62, it is to be appreciated that other arrangements are envisioned as well. Moreover, it is envisioned that the cutting edges may be obliquely arranged with each other if such arrangement is the intended orientation of the blades. Otherwise stated, blades of a cutting blade assembly are not aligned if subsequent to adjustment of the relative positioning of the blades, the blades are mistakenly or undesirably askew from their intended orientation and use. In certain instances, an askew orientation of the blades may include an angulation or undesired orientation of one blade relative to another.

Furthermore, although described in terms of the movable blade 58 being longitudinally adjustable, it is within the scope of the present disclosure that either or both blades 58, 62 may be longitudinally movable relative to each other.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A hair cutting system, comprising:

a handle defining a longitudinal axis extending along a length of the handle;

a strut mounted to the handle;

a hair cutting blade assembly coupled to the strut, the cutting blade assembly including:

a stationary blade defining cutting teeth having blade edges;

a movable blade defining cutting teeth having blade edges and capable of reciprocal movement relative to the stationary blade in a direction transverse to the longitudinal axis of the handle, the movable blade and the stationary blade being movable relative to each other in a direction with respect to the longitudinal axis of the handle to selectively adjust a position of the movable blade relative to the stationary blade, to thereby selectively vary a distance between the blade edges of the stationary blade and the blade edges of the movable blade;

a releasable lock to selectively lock and release the stationary blade and the movable blade with respect to each other; and an adjustment tool mounted to the strut and operatively engageable with the movable blade, the adjustment tool and the strut correspondingly configured such that movement of the adjustment tool relative to the longitudinal axis of the handle and along the strut imparts corresponding movement to the movable blade to thereby adjust the position of the movable blade relative to the stationary blade.

2. The hair cutting system according to claim 1 wherein the adjustment tool is releasably mounted to the strut.

3. The hair cutting system according to claim 1 wherein the releasable lock comprises one or more alignment fasteners coupled to the movable blade, the one or more alignment fasteners configured to releasably secure the movable blade at a plurality of select positions relative to the stationary blade.

4. The hair cutting system according to claim 3 wherein the adjustment tool includes a driver releasably mounted thereto, the driver manipulatable to control movement of the one or more alignment fasteners.

5. The hair cutting assembly according to claim 1 wherein the adjustment tool and the movable blade include cooperating contacting surfaces such that the movement of the adjustment tool causes corresponding movement of the movable blade.

6. A hair cutting system, which comprises:

a handle defining a longitudinal axis;

a strut mounted to the handle;

a hair cutting blade assembly coupled to the strut, the cutting blade assembly including:

a stationary blade defining cutting teeth having blade edges;

a movable blade defining cutting teeth having blade edges and capable of reciprocal movement relative to the stationary blade in a direction transverse to the longitudinal axis defined by the handle, the movable blade and the stationary blade being movable relative to each other in a direction relative to the longitudinal axis defined by the handle to selectively adjust a position of the movable blade relative to the stationary blade to selectively vary a distance between the blade edges of the stationary blade and the blade edges of the movable blade; and a releasable lock to selectively lock and release the stationary blade and the movable blade with respect to each other; and an adjustment tool mounted relative to the cutting blade assembly and operatively engageable with the movable blade, the adjustment tool and the strut correspondingly configured such that movement of the adjustment tool imparts corresponding movement of the movable blade to adjust the position of the movable blade relative to the stationary blade;

wherein the adjustment tool includes inner walls defining an internal recess for at least partially receiving the strut, the inner walls cooperating with the strut during movement of the movable blade to facilitate linear movement of the movable blade relative to the stationary blade.

7. The hair cutting system according to claim 6 wherein the releasable lock comprises at least one alignment fastener coupled to the movable blade, the alignment fastener configured to releasably secure the movable blade at a plurality of select positions relative to the stationary blade.

8. The hair cutting system according to claim 7 wherein the alignment fastener includes an alignment screw.

9. The hair cutting system according to claim 8 including a slider mounted within a recess of the stationary blade, the slider including a threaded anchor for at least partial threaded reception of the alignment screw, the slider configured to reciprocate within the recess of the stationary blade during reciprocal movement of the movable blade.

10. The hair cutting system according to claim 9 wherein the adjustment tool includes a driver releasably mounted thereto, the driver manipulatable to control movement of the alignment screw.

11. The hair cutting system according to claim 10 including two of the alignment screws.

12. The hair cutting system according to claim 11 wherein the two alignment screws are accessible to the driver with the cutting assembly mounted to the strut.

13. The hair cutting system according to claim 9 including a bracket disposed between the movable blade and the strut, the bracket including at least one elongated opening to receive the screw, the screw traversing the elongated opening during movement of the movable blade.

14. The hair cutting system according to claim 6 wherein the inner walls of the adjustment tool are in contacting relation with the strut.

15. A hair cutting system, which comprises:

a handle defining a longitudinal axis, the handle including a rotating shaft;

a hair cutting blade assembly including:

a fixed strut configured for securement to the handle and extend outwardly therefrom;

a stationary blade defining cutting teeth having blade edges, the stationary blade secured to the strut;

a movable blade coupled to the rotating shaft of the handle, the movable blade defining cutting teeth having blade edges and capable of reciprocal movement relative to the stationary blade in a direction transverse to the longitudinal axis defined by the handle in response to rotation of the rotating shaft, the movable blade and the stationary blade being movable relative to each other in a direction relative to the longitudinal axis defined by the handle to selectively adjust a position of the movable blade relative to the stationary blade to selectively vary a distance between the blade edges of the stationary blade and the blade edges of the movable blade; and one or more alignment fasteners to releasably secure the movable blade at a plurality of select positions relative to the stationary blade;

wherein the strut is configured to space the cutting blade assembly relative to the handle along the longitudinal axis to facilitate access to the one or more fasteners without requiring removal of the cutting blade assembly from the handle.

16. The hair cutting system according to claim 15 including a slider mounted relative to the stationary blade, the slider including one or more anchor segments for reception of the one or more alignment fasteners to secure the movable blade to the slider, the slider configured to reciprocate relative to the stationary blade during reciprocal movement of the movable blade.

17. The hair cutting system according to claim 16 wherein the stationary blade defines a recess for at least partial reception of the slider, the slider traversing the recess during reciprocal movement of the movable blade.

18. The hair cutting system according to claim 17 wherein the movable blade includes one or more openings for reception of the one or more alignment fasteners and the one or more anchor segments, the one or more openings elongated to accommodate relative movement of the movable blade and the stationary blade to selectively vary the distance between the blade edges of the stationary blade and the blade edges of the movable blade.

19. The hair cutting system according to claim 18 including a bracket mounted to the movable blade, the bracket coupled to an eccentric shaft extending from the handle, wherein rotation of the eccentric shaft imparts reciprocating movement of the bracket and the movable blade;

wherein the bracket includes elongated bracket openings for reception of the alignment screws;

wherein the bracket is movable with the movable blade and relative to the stationary blade when adjusting the position of the movable blade to selectively vary the distance between the blade edges of the stationary blade and the blade edges of the movable blade; and wherein the bracket includes a central segment to receive the rotating shaft of the handle.

20. The hair cutting system according to claim 15 including a member mounted to the strut and operatively engageable with the movable blade, the member and the strut correspondingly configured such that movement of the member relative to the longitudinal axis of the handle and along the strut imparts corresponding movement to the movable blade to thereby selectively adjust the position of the movable blade relative to the stationary blade and the distance between the blade edges of the movable blade and the blade edges of the stationary blade.

* * * * *